United States Patent [19]

Hooie et al.

[11] Patent Number: 4,535,913

[45] Date of Patent: Aug. 20, 1985

[54] GAME CHIP STORAGE AND DISPENSING DEVICE

[76] Inventors: David W. Hooie; Johannes Daldosch, both of Box 29, 730 NW. 90th St., Miami, Fla. 33138

[21] Appl. No.: 592,451

[22] Filed: Mar. 22, 1984

Related U.S. Application Data

[63] Continuation-in-part of Ser. No. 577,980, Feb. 8, 1984, abandoned.

[51] Int. Cl.[3] ..... B65G 59/00

[52] U.S. Cl. ..... 221/251; 221/297; 221/310; 221/299; 133/5 A; 133/6

[58] Field of Search ..... 221/297, 298, 299, 301, 221/310, 251, 303; 133/5 A, 6, 1 R, 5 R; 294/65.5; 273/144 A, 269

[56] References Cited

U.S. PATENT DOCUMENTS

| | | | |
|---|---|---|---|
| 1,524,420 | 1/1925 | Bohlman | 221/297 |
| 3,436,163 | 4/1969 | Calabrese et al. | 401/195 |
| 3,586,210 | 6/1971 | Andamasaris | 133/5 A |
| 3,747,613 | 7/1973 | Westburg et al. | 133/1 |
| 3,765,429 | 10/1973 | Rocheleau | 133/5 A |
| 3,976,219 | 8/1976 | Pagnoni | 221/310 |
| 4,172,597 | 10/1979 | Smith et al. | 294/65.5 |

*Primary Examiner*—Joseph J. Rolla
*Assistant Examiner*—Andrew Jones
*Attorney, Agent, or Firm*—Oltman and Flynn

[57] ABSTRACT

A game chip storage and dispensing device having telescopically slidable inner and outer sleeves. First and second sets of flexible and resilient fingers on the lower end of the inner sleeve have inwardly extending lateral protrusions on their lower ends for engaging respectively beneath the lowermost chip in a stack of chips in the inner sleeve and the next chip above. When the outer sleeve is moved down along the inner sleeve, the first fingers release the lowermost chip and the second fingers hold the next chip above. When the outer sleeve moves back up, the second fingers release the next chip to drop onto the lateral protrusions of the first fingers.

9 Claims, 9 Drawing Figures

GAME CHIP STORAGE AND DISPENSING DEVICE

RELATED APPLICATION

This application is a continuation-in-part of copending application Ser. No. 06/577,980, filed on Feb. 8, 1984 by the present inventors, now abandoned.

SUMMARY OF THE INVENTION

This invention relates to a device for storing and dispensing game chips, such as for "Bingo" or similar board games.

In accordance with the preferred embodiment of this invention, an upright inner sleeve can hold a stack of game chips and an outer sleeve is telescopically slidable on the outside of the inner sleeve. The inner sleeve has first and second sets of flexible and resilient fingers on its lower end, each having inwardly extending lower end protrusions for engagement with chips at the bottom of the stack. The protrusions of the first set of fingers engage beneath the lowermost chip in the stack when the outer sleeve is up along the inner sleeve and they release this chip when the outer sleeve is moved down. The protrusions of the second set of fingers move in to engage beneath the next chip when the outer sleeve is moved down and they release that chip when the outer sleeve is moved back up, so that chip now is the lowermost chip in the stack and can drop onto the protrusions of the first set of fingers. With this arrangement, a single chip can be dispensed from the device each time the outer sleeve is moved down.

A principal object of this invention is to provide a novel device for storing a stack of game chips and selectively dispensing them onto a surface below, such as a game board.

Another object of this invention is to provide such a device which may be conveniently operated manually by a person playing a board game of chance, such as "Bingo" or the like.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
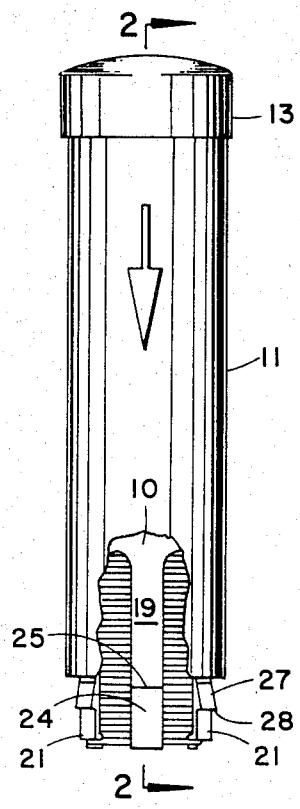
FIG. 1 is an elevational view of the present invention.
Figure 2:
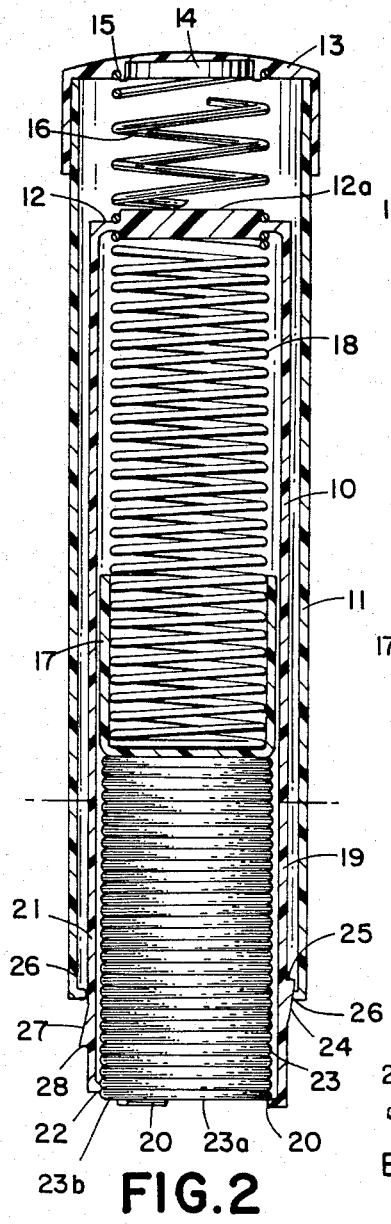
FIG. 2 is a longitudinal section taken along the line 2—2 in FIG. 1 with the outer sleeve of the device in its "up" position along the inner sleeve.
Figure 4:
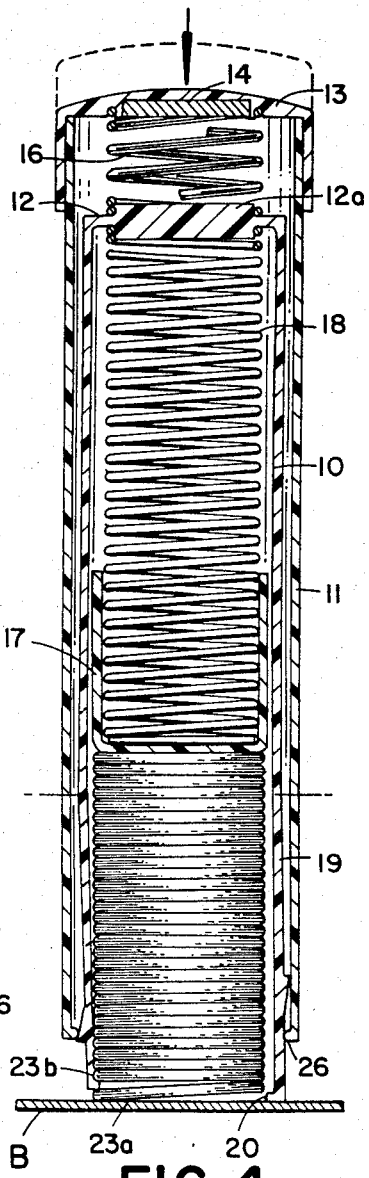
FIG. 4 is a view similar to FIG. 2 with the outer sleeve moved down along the inner sleeve to dispense a single game chip from the bottom of the stack.
Figure 6:
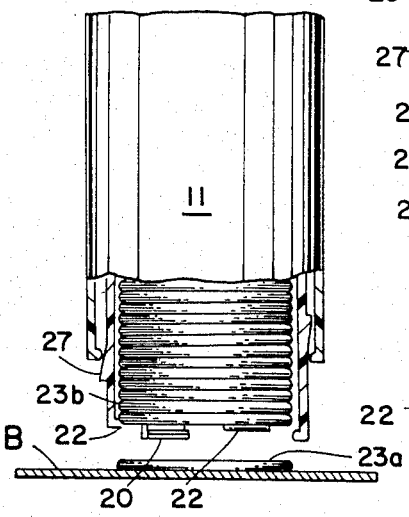
FIG. 6 shows the lower end of the device, partly in elevation and partly in section, as it is being raised after dropping the lowermost chip onto the game board.
Figure 3:
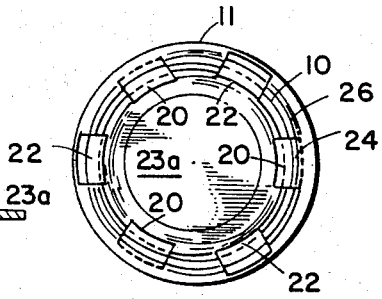
FIG. 3 is a bottom plan view of the device in FIG. 2.
Figure 5:
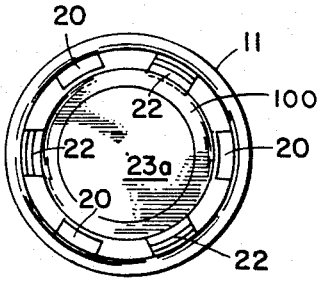
FIG. 5 is a bottom plan view of the device in the position shown in FIG. 4.
Figure 7:
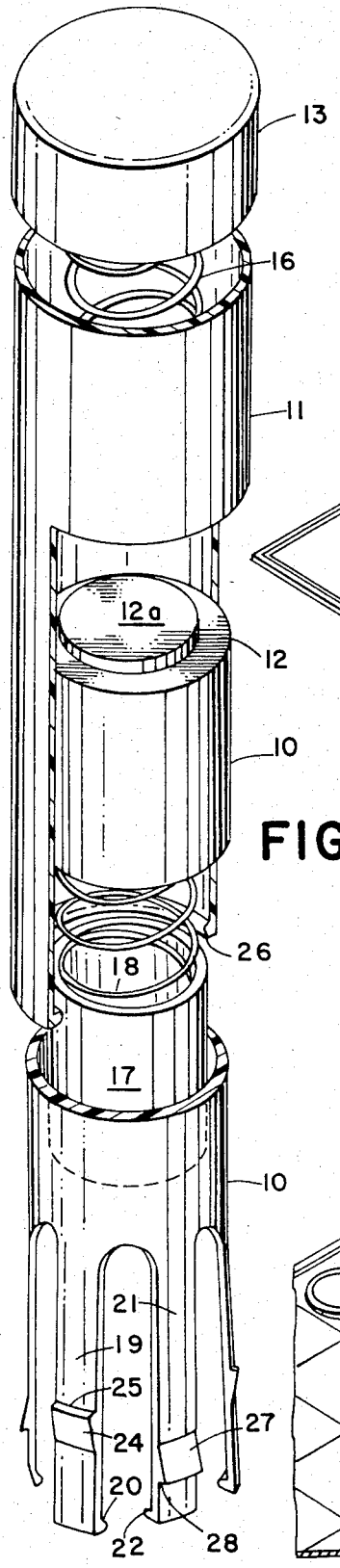
FIG. 7 is an exploded perspective view of the device with parts broken away for clarity.
Figure 8:
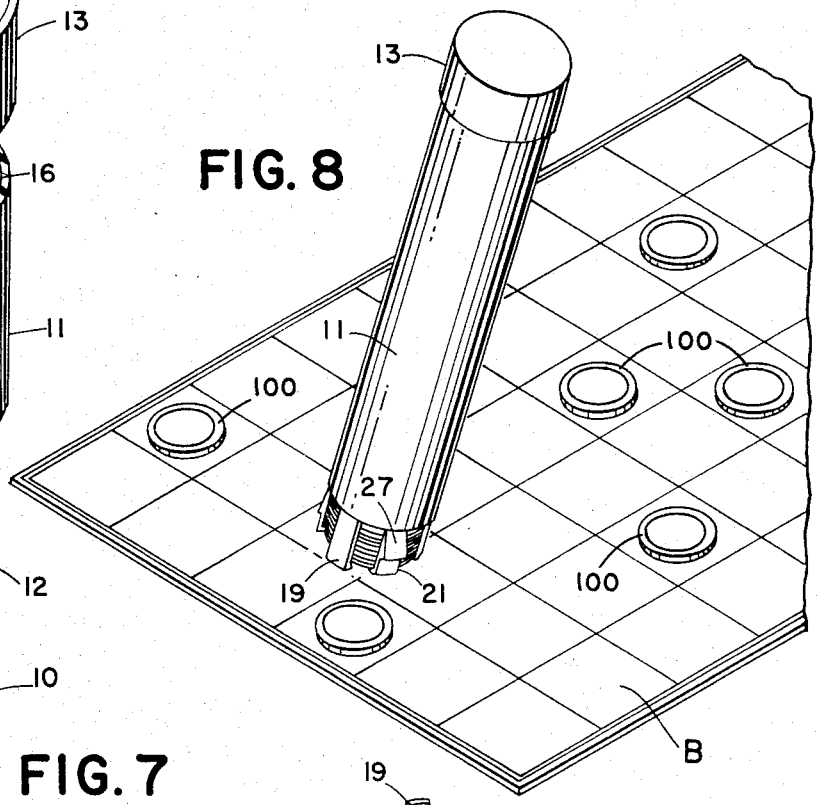
FIG. 8 is a perspective view showing the device over a game board after it has been operated to dispense a chip.

Referring to FIGS. 2 and 4, the present game chip storage and dispensing device comprises a cylindrical inner sleeve 10 and a cylindrical outer sleeve 11 of slightly larger diameter surrounding the inner sleeve telescopically and slidable along it. Both sleeves preferably are of suitable plastic material. The inner sleeve is closed at the top by an end wall 12 having a thickened central segment **12*a* of circular outline. The outer sleeve 11 is closed at the top by a cap 13 which has a downwardly-facing central recess or depression which holds a permanent magnet 14 and a shallow groove 15 which encircles this depression. A coil spring 16 has its upper end seated in groove 15 and its lower end closely surrounding the thickened central segment 12*a* of the top wall 12 of inner sleeve 10. Spring 16 is under compression and it biases the outer sleeve 11 upward along the inner sleeve 10**.

The inner sleeve 10 slidably receives a cup-shaped follower 17 haveing a flat, circular bottom wall and a cylindrical side wall extending up from it. A coil spring 18 has its lower end received in follower 17 and its upper end extending snugly around the thickened central segment **12*a* of the top wall 12 of inner sleeve 10. Spring 18 is under compression and it biases follower 17 downward along the inner sleeve 10**.

At its lower end the inner sleeve 10 has a first set of circumferentially spaced, flexible and resilient fingers 19, each of which terminates at its lower end in a laterally inwardly extending protrusion 20. In one practical embodiment there are three fingers 19 of the first set located at 120 degree intervals circumferentially of the inner sleeve 10. The inner sleeve also has a second set of flexible and resilient fingers 21, each located midway circumferentially between two fingers of the first set. That is, the fingers 21 are at 120 degree intervals from each other and at 60 degree intervals from the fingers 19 of the first set. Each finger 21 of the second set at its lower end presents a laterally inwardly extending protrusion 22. The inner sleeve holds a stack of thin circular game chips 23. The protrusions 22 on the fingers 21 of the second set are spaced above the protrusions 20 on the fingers 19 of the first set by the thickness of a single game chip 23, for a purpose explained hereinafter. The chips 23 may have rims 100 of magnetic material such as magnetic metal.

Each finger 19 of the first set of fingers on inner sleeve 10 has a cam 24 on the outside which presents an upwardly and laterally outwardly inclined surface and a transverse horizontal shoulder 25 at the top. At the circumferential position of each of these cams the outer sleeve 11 presents a laterally inwardly extending lip 26 on its lower end. The outer sleeve 11 is rigid, and when it is up along the inner tube 10 (FIG. 2) its lower end lip 26 pushes radially inward on the inner sleeve fingers 19 at the cams 24 and deforms these fingers laterally inward enough to position the protrusions 20 on their lower ends beneath the lowermost chip **23*a* in the stack of chips in the inner sleeve 10. When the outer sleeve 11 is pushed down along the inner sleeve 10 to the position shown in FIG. 4, the lip 26 on the outer sleeve slides down along the cams 24 on the inner sleeve and gradually releases the inward force on the inner sleeve fingers 19, so that these fingers spring out far enough to move their lower end protrusions 20 out from beneath the lowermost chip 23***a* in the stack.

Each finger 21 of the second set of fingers on inner sleeve 10 has a cam 27 on the outside which presents a downwardly and laterally outwardly inclined surface and a transverse shoulder 28 at the bottom. At the circumferential position of each cam 27 the outer sleeve 11 presents the previously mentioned inwardly extending lip 26 on its lower end. When the outer sleeve 11 is up along the inner sleeve 10, as shown in FIG. 2, the lip 26 on the lower end of the outer sleeve is above the cams 27 and the preformed shape of the fingers 21 on inner sleeve 10 is such that the lower end protrusions 22 on these fingers are at the edge of the game chips but not beneath them. When the outer sleeve 11 is pushed down to the position shown in FIG. 4 the lip 26 on the outer sleeve slides down along the cams 27 on fingers 21 and gradually forces these fingers laterally inward, so that the protrusions 22 on the lower end of these fingers engage beneath the next-to-the-lowest chip 23*b* in the stack.

OPERATION

Normally spring 16 biases the outer sleeve 11 up along the inner sleeve 10, causing the lower end protrusions 20 on the fingers 19 of the first set of fingers on the inner sleeve 10 to engage beneath the lowermost chip 23*a* in the stack. Spring 18 pushes down on the game chips inside the inner sleeve 10.

The storage and dispensing device can be placed over a game board B, with the lower end protrusions 20 on the inner sleeve's first set of flexible and resilient fingers 19 engaging the top of the game board.

When the user pushes down on the outer sleeve 11, the fingers 19 of the first set spring out and release the lowermost game chip 23*a* onto the game board. During this same downward stroke of the outer sleeve 11, the fingers 21 of the second set of fingers on the inner sleeve are deformed laterally inward, causing their lower end protrusions 22 to engage beneath the next chip 23*b* in the stack.

If the user now lifts the device up from the game board and releases the downward force on its outer sleeve 11, the lip 26 on the lower end of the outer sleeve will slide up along the cams 27 and release the fingers 21 of the second set of fingers on the inner sleeve 10. At the same time, this lip 26 on the lower end of the outer sleeve 11 will force the fingers 19 of the first set inward, causing their lower end protrusions 20 to move laterally inward to catch the next game chip 23*b* as it is released by the lower end protrusions 22 on the fingers 21 of the second set. In this way, just a single chip at a time is deposited on the game board for each downward and return (upward) stroke of the outer sleeve 11 along the inner sleeve 10.

Figure 9:
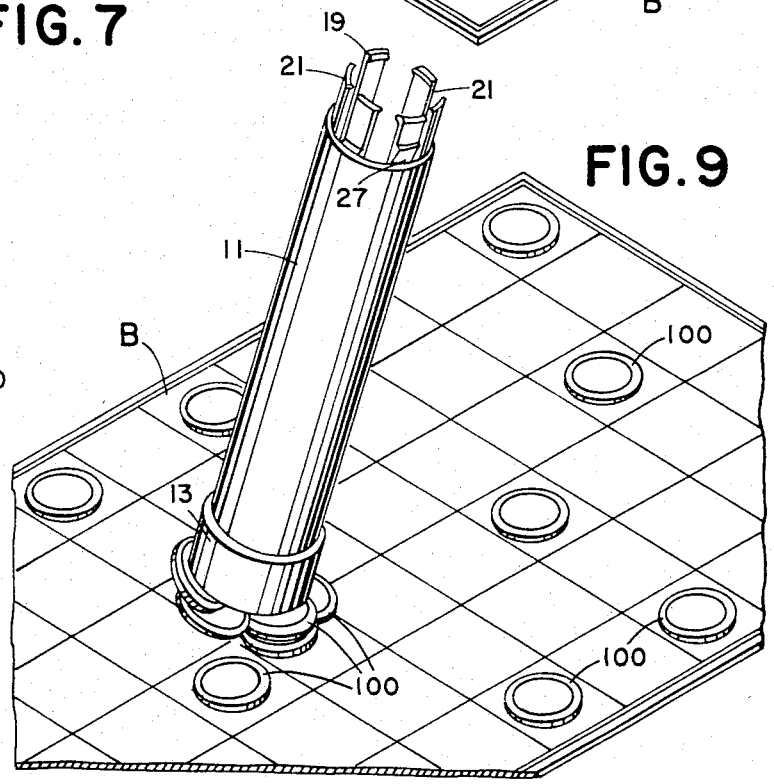
FIG. 9 is a view similar to FIG. 8 but showing the device inverted.

If desired, several game chips can be deposited in rapid succession on the game board by holding the device at a non-vertical acute angle to the game board and moving the outer sleeve 11 up and down along the inner sleeve 10. In the inverted position of the device shown in FIG. 9, the magnet 14 inside the cap serves to pick up chips by attracting the metal rims 100 as shown. The sleeves, follower and cap are made of plastic or other suitable non-magnetic material, and the chips are made of suitable plastic with magnetic metal rims.

We claim:

1. In a game chip storage and dispensing device having an inner sleeve adapted to extend upright for holding a stack of chips, and means for urging the chips downward along said inner sleeve;

and an outer sleeve telescopically mounted on the outside of said inner sleeve and reciprocable up and down said inner sleeve;

the improvement which comprises:

first and second sets of flexible and resilient fingers extending down from said inner sleeve at circumferentially spaced locations thereon;

each finger of said first set having a lateral protrusion extending inward for engagement beneath the lowermost chip in the stack, each finger of said first set having a normal unstressed position permitting downward movement of the chips past said lateral protrusion;

each finger of said second set having a lateral protrusion extending inward for engagement beneath a chip in the stack and located higher than the protrusions on the fingers of said first set by substantially the thickness of one chip, each finger of said second set having a normal unstressed position permitting downward movement of the chips past its lateral protrusion;

and means on each of said sleeves which interact to (1) in a first position of the outer sleeve along the inner sleeve, force the fingers of said first set inward to position said protrusions thereon beneath the lowermost chip in the stack and at the same time permit the fingers of the second set to assume their normal unstressed positions, and (2) in a second position of the outer sleeve along the inner sleeve, releases the fingers of said first set to assume their normal unstressed positions to enable the lowermost chip to drop from the stack and force the fingers of the second set in to position the protrusions thereon beneath the next chip immediately above the chip which drops from the stack, and (3) when the outer sleeve is returned to said first position along the inner sleeve, release the fingers of said second set to assume their normal unstressed positions to release said next chip in the stack and force the fingers of said first set in to position their lateral protrusions beneath said next chip.

2. A device according to claim 1 wherein said means acting between said sleeves comprises:

a cam on the outside of each finger of said first set presenting an upwardly and laterally outwardly inclined surface;

a cam on the outside of each finger of said second set presenting a downwardly and laterally outwardly inclined surface;

and laterally inwardly extending lip means on the lower end of said outer sleeve slidably engageable with said cams on the fingers of said first and second sets to: (a) force the fingers of said first set laterally inward when said outer sleeve is positioned upward or moves upward along said inner sleeve; and (b) force the fingers of said second set inward when said outer sleeve moves downward along said inner sleeve.

3. A device according to claim 2 and further comprising:

spring means biasing said outer sleeve upward along said inner sleeve.

4. A device according to claim 3 and further comprising:

spring means biasing said game chips downward along the inside of said first sleeve.

5. A device according to claim 3, wherein all of said lateral protrusions are on the lower ends of the respective fingers.

6. In a game chip storage and dispensing device having:

a sleeve adapted to extend upright for holding a stack of chips, and means for urging the chips downward along said sleeve;

the improvement which comprises:

first and second sets of flexible and resilient fingers extending down from said sleeve at circumferentially spaced locations thereon;

each finger of said first set having a lateral protrusion extending inward for engagement beneath the lowermost chip in the stack, each finger of said first set having a normal unstressed position permitting downward movement of the chips past said lateral protrusion;

each finger of said second set having a lateral protrusion extending inward for engagement beneath a chip in the stack and located higher than the protrusions on the fingers of said first set by substantially the thickness of one chip, each finger of said second set having a normal unstressed position permitting downward movement of the chips past its lateral protrusion;

and operating means for: (a) forcing the fingers of said first set toward the stack of chips to position said protrusions thereon beneath the lowermost chip in the stack while permitting the fingers of said second set to assume their normal unstressed position; and (b) permitting the fingers of said first set to assume their normal unstressed positions to enable said lowermost chip to drop from the stack while forcing the fingers of said second set toward the stack of chips to position their protrusions beneath the next chip immediately above the chip which drops from the stack.

7. A device according to claim 6 wherein said operating means is adjustable on said sleeve between a position forcing the first set of fingers in and a position forcing the second set of fingers in.

8. A device according to claim 7 and further comprising spring means biasing said operating means to said position forcing the first set of fingers in.

9. A device according to claim 1 in which said outer sleeve has a cap which retains a magnet for picking up chips having magnetic material.

* * * * *